US009784542B1

(12) United States Patent
McMillan

(10) Patent No.: US 9,784,542 B1
(45) Date of Patent: Oct. 10, 2017

(54) ARROW TRACKING SYSTEM

(71) Applicant: Stefen McMillan, Boiling Brook, IL (US)

(72) Inventor: Stefen McMillan, Boiling Brook, IL (US)

( * ) Notice: Subject to any disclaimer, the term of this patent is extended or adjusted under 35 U.S.C. 154(b) by 0 days.

(21) Appl. No.: 15/210,981

(22) Filed: Jul. 15, 2016

(51) Int. Cl.
*F42B 6/04* (2006.01)
*F42B 6/08* (2006.01)
*F42B 12/36* (2006.01)
*F42B 12/40* (2006.01)

(52) U.S. Cl.
CPC ..... *F42B 12/362* (2013.01); *F42B 6/04* (2013.01); *F42B 6/08* (2013.01); *F42B 12/40* (2013.01)

(58) Field of Classification Search
CPC ..... F42B 6/04; F42B 6/08; F42B 12/362
See application file for complete search history.

(56) References Cited

U.S. PATENT DOCUMENTS 3,066,940 A * 12/1962 De Lonais ..... F42B 12/54 473/581
3,893,866 A * 7/1975 Hollingsworth ..... F42B 12/54 102/512
4,380,340 A 4/1983 Simo
4,463,953 A * 8/1984 Jordan ..... F42B 12/54 473/581
4,940,246 A 7/1990 Stagg
6,669,586 B2 12/2003 Barrie et al.
7,255,659 B2 8/2007 Jones
7,374,505 B2 5/2008 Polando
7,488,267 B2 * 2/2009 Hunt ..... F42B 6/04 473/578
8,678,961 B2 * 3/2014 Wiegand ..... A61K 35/60 43/1
D707,787 S 6/2014 Moehring
8,746,146 B1 6/2014 Wiegand
2008/0234078 A1 * 9/2008 Eyerman ..... F42B 12/362 473/581

* cited by examiner

*Primary Examiner* — John Ricci

(57) ABSTRACT

An arrow tracking system includes an arrow that has a shaft and a head. The head is removably coupled to the shaft. The arrow is launched at an animal thereby facilitating the animal to be killed. A reservoir is coupled to the arrow and the reservoir contains a fluid dye. The fluid dye is selectively released from the reservoir when the arrow strikes the animal. Thus, the fluid dye is released into the animal's blood stream. The fluid dye reacts with blood thereby enhancing visibility of blood released from the animal thereby. Thus, the fluid dye enhances tracking the animal during hunting.

4 Claims, 3 Drawing Sheets

ARROW TRACKING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to tracking devices and more particularly pertains to a new tracking device for enhancing visibility of blood from an animal.

BRIEF SUMMARY OF THE INVENTION

An embodiment of the disclosure meets the needs presented above by generally comprising an arrow that has a shaft and a head. The head is removably coupled to the shaft. The arrow is launched at an animal thereby facilitating the animal to be killed. A reservoir is coupled to the arrow and the reservoir contains a fluid dye. The fluid dye is selectively released from the reservoir when the arrow strikes the animal. Thus, the fluid dye is released into the animal's blood stream. The fluid dye reacts with blood thereby enhancing visibility of blood released from the animal thereby. Thus, the fluid dye enhances tracking the animal during hunting.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
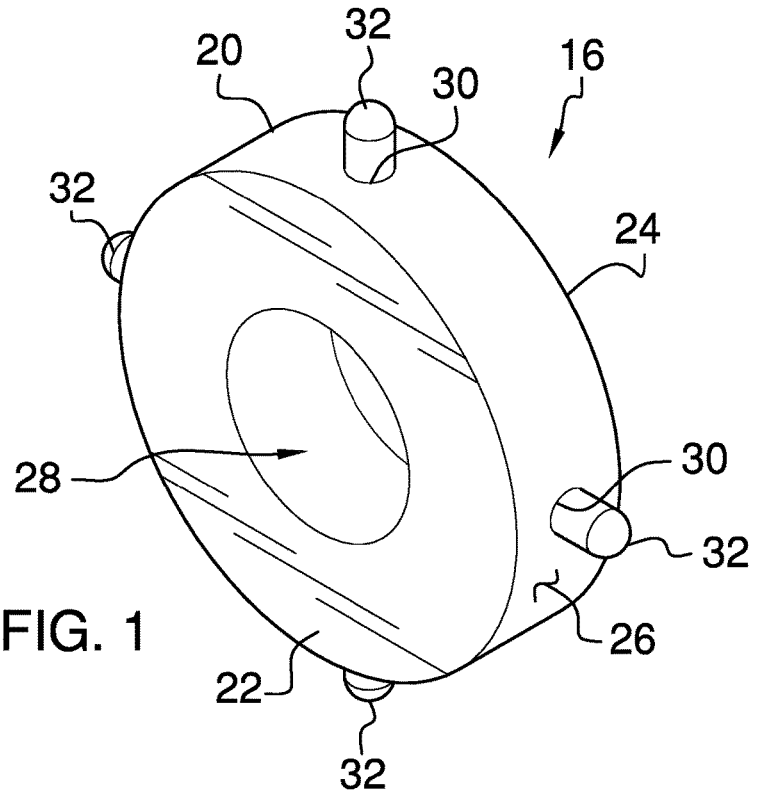
FIG. 1 is a perspective view of an arrow tracking system according to an embodiment of the disclosure.
Figure 2:
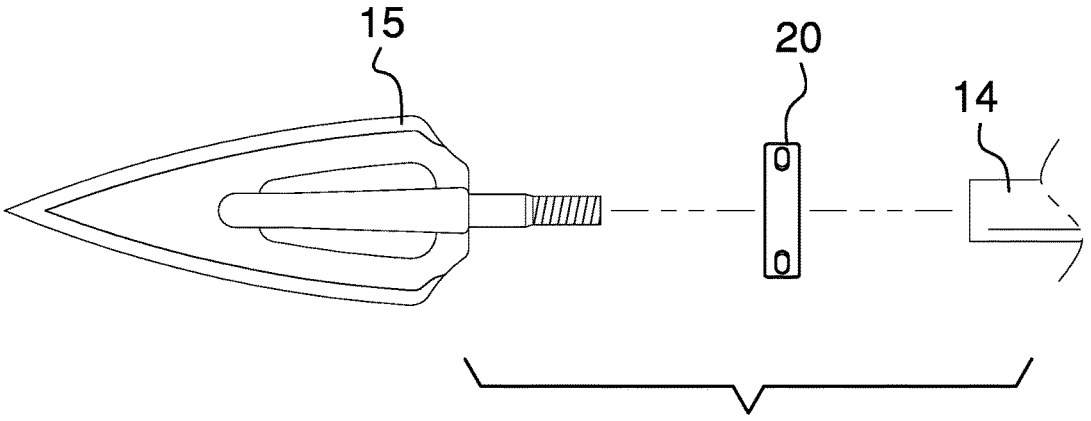
FIG. 2 is an exploded perspective view of an embodiment of the disclosure.
Figure 3:
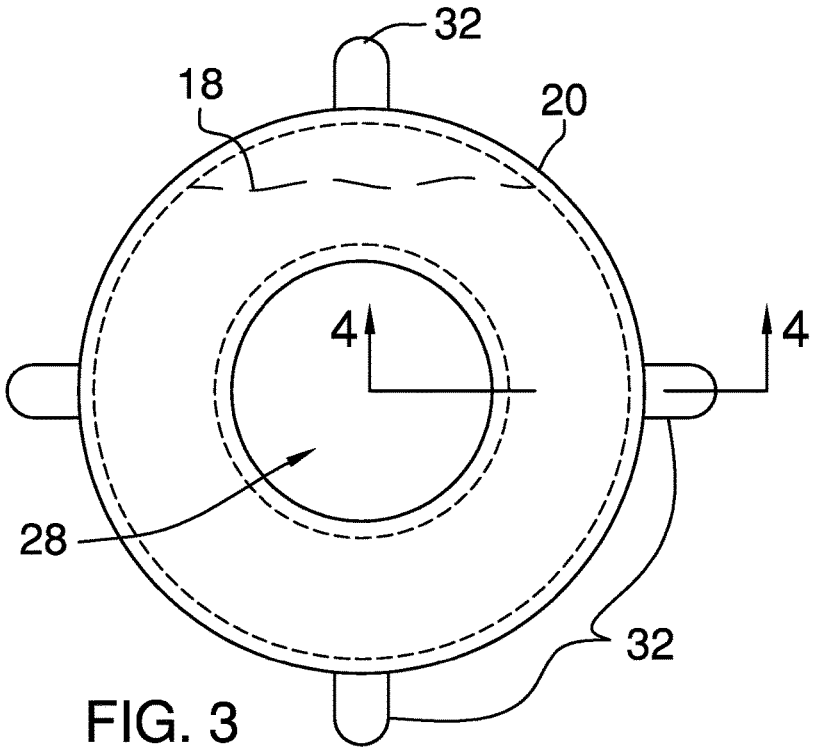
FIG. 3 is a front phantom view of an embodiment of the disclosure.
Figure 4:
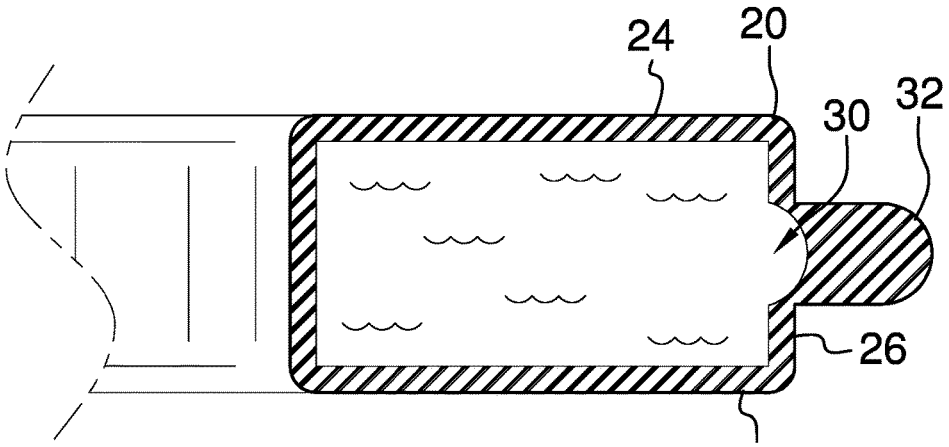
FIG. 4 is a cross sectional view taken along line 4-4 of FIG. 3 of an embodiment of the disclosure.
Figure 5:
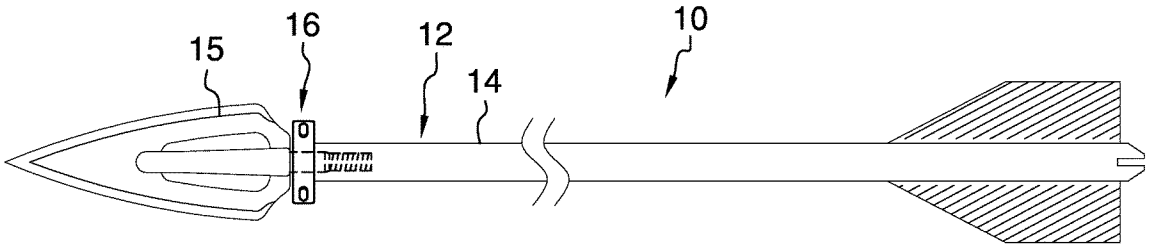
FIG. 5 is a perspective in-use view of an embodiment of the disclosure.

With reference now to the drawings, and in particular to FIGS. 1 through 5 thereof, a new tracking device embodying the principles and concepts of an embodiment of the disclosure and generally designated by the reference numeral 10 will be described.

As best illustrated in FIGS. 1 through 5, the arrow tracking system 10 generally comprises an arrow 12 that has a shaft 14 and a head 15. The head 15 is removably coupled to the shaft 14. The arrow 12 may be launched at an animal thereby facilitating the animal to be killed. The arrow 12 may be a hunting arrow 12 of any conventional design. Moreover, the arrow 12 may be launched with a bow of any conventional design.

A reservoir 16 is provided and the reservoir 16 is coupled to the arrow 12. The reservoir 16 contains a fluid dye 18. The fluid dye 18 is selectively released from the reservoir 16 when the arrow 12 strikes the animal. Thus, the fluid dye 18 is released into the animal's blood stream and the fluid dye 18 reacts with the animal's blood. The fluid dye 18 may be a chemiluminescent dye or the like. Thus, the fluid dye 18 enhances visibility of blood released from the animal thereby enhancing tracking the animal during hunting. The fluid dye 18 may comprise Luminol or the like.

The reservoir 16 comprises a collar 20 that has a first surface 22, a second surface 24 and an outer surface 26 extending therebetween. The outer surface 26 is continuous such that the collar 20 has a circular shape. The collar 20 has an opening 28 extending through the first surface 22 and the second surface 24. The collar 20 is substantially hollow and the fluid dye 18 is contained within the collar 20. The shaft 14 of the arrow 12 is extended through the opening 28 having the collar 20 being positioned behind the head 15.

A plurality of apertures 30 extends through the outer surface 26. The apertures 30 are spaced apart from each other and distributed around the collar 20. A plurality of knobs 32 is provided. Each of the knobs 32 is coupled to and extends away from the outer surface 26. The knobs 32 are spaced apart from each other and are distributed around the collar 20. Each of the knobs 32 is positioned over an associated one of the apertures 30 and each of the knobs 32 closes the associated aperture 30.

Each of the knobs 32 frictionally engages the animal when the arrow 12 strikes the animal. Thus, the knobs 32 are broken away from the collar 20. Each of the apertures 30 are exposed when the knobs 32 are broken away from the outer surface 26. The fluid dye 18 is released from the each of the apertures 30. Thus, the fluid dye 18 is released into the bloodstream of the animal.

In use, the collar 20 is positioned on the shaft 14 of the arrow 12 and the head 15 is coupled to the shaft 14. The arrow 12 is launched at the animal during hunting. Each of the knobs 32 frictionally engages the animal when the arrow 12 strikes the animal. Each of the knobs 32 is broken away from the collar 20 when the arrow 12 strikes the animal. Thus, the fluid dye 18 contained in the collar 20 is released into the animal's blood stream. The fluid dye 18 reacts with the animals' blood. The fluid dye 18 enhances visibility of blood released from the animal when the animal is shot with the arrow 12. Thus, the fluid dye 18 enhances tracking the animal when the animal is shot.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An arrow tracking system comprising:

an arrow having a shaft and a head, said head being removably coupled to said shaft, said arrow being configured to be launched at an animal thereby facilitating the animal to be killed;

a reservoir being coupled to said arrow, said reservoir containing a fluid dye, said fluid dye being selectively released from said reservoir when said arrow strikes the animal wherein said fluid dye is configured to be released into the animal's blood stream, said fluid dye being configured to react with blood thereby enhancing visibility of blood released from the animal thereby enhancing tracking the animal during hunting, wherein said reservoir comprises a collar having a first surface, a second surface and an outer surface extending therebetween, said outer surface being continuous such that said collar has a circular shape, said collar having an opening extending through said first surface and said second surface; and a plurality of knobs, each of said knobs being coupled to and extending away from said outer surface, said knobs being spaced apart from each other and being distributed around said collar, each of said knobs being configured to frictionally engage the animal when said arrow strikes the animal thereby facilitating said knobs to be broken away from said collar.

2. The system according to claim 1, wherein said collar is substantially hollow, said fluid dye being contained within said collar, said shaft of said arrow being extended through said opening having said collar being positioned behind said head.

3. The system according to claim 1, wherein each of said knobs creates a hole in said outer surface when said knobs are broken away from said outer surface having said dye being released from said hole wherein said dye is configured to be released into the bloodstream of the animal.

4. An arrow tracking system comprising:

an arrow having a shaft and a head, said head being removably coupled to said shaft, said arrow being configured to be launched at an animal thereby facilitating the animal to be killed; and a reservoir being coupled to said arrow, said reservoir containing a fluid dye, said fluid dye being selectively released from said reservoir when said arrow strikes the animal wherein said fluid dye is configured to be released into the animal's blood stream, said fluid dye being configured to react with blood thereby enhancing visibility of blood released from the animal thereby enhancing tracking the animal during hunting, said reservoir comprising:

a collar having a first surface, a second surface and an outer surface extending therebetween, said outer surface being continuous such that said collar has a circular shape, said collar having an opening extending through said first surface and said second surface, said collar being substantially hollow, said fluid dye being contained within said collar, said shaft of said arrow being extended through said opening having said collar being positioned behind said head, and a plurality of knobs, each of said knobs being coupled to and extending away from said outer surface, said knobs being spaced apart from each other and being distributed around said collar, each of said knobs being configured to frictionally engage the animal when said arrow strikes the animal thereby facilitating said knobs to be broken away from said collar, each of said knobs creating a hole in said outer surface when said knobs are broken away from said outer surface having said dye being released from said hole wherein said dye is configured to be released into the bloodstream of the animal.

* * * * *